US009121160B2

(12) United States Patent
Hughes

(10) Patent No.: US 9,121,160 B2
(45) Date of Patent: Sep. 1, 2015

(54) CONNECTION ASSEMBLY

(75) Inventor: Benjamin D. Hughes, Midland (AU)

(73) Assignee: Talon Engineering SDN BHD, Ipoh, PK (MY)

( * ) Notice: Subject to any disclaimer, the term of this patent is extended or adjusted under 35 U.S.C. 154(b) by 153 days.

(21) Appl. No.: 13/991,431

(22) PCT Filed: Dec. 7, 2011

(86) PCT No.: PCT/AU2011/001585

§ 371 (c)(1),
(2), (4) Date: Jun. 4, 2013

(87) PCT Pub. No.: WO2012/075531

PCT Pub. Date: Jun. 14, 2012

(65) Prior Publication Data

US 2013/0247428 A1 Sep. 26, 2013

Related U.S. Application Data

(63) Continuation-in-part of application No. 13/155,472, filed on Jun. 8, 2011, now Pat. No. 8,122,623.

(30) Foreign Application Priority Data

Dec. 7, 2010 (AU) ..... 2010905369
Mar. 28, 2011 (AU) ..... 2011201408

(51) Int. Cl.
*E02F 9/28* (2006.01)

(52) U.S. Cl.
CPC ..... *E02F 9/2825* (2013.01); *E02F 9/2841* (2013.01); *E02F 9/2891* (2013.01)

(58) Field of Classification Search
CPC ..... E02F 9/2825; E02F 9/2833; E02F 9/2841; E02F 9/2891
USPC ..... 37/446, 450–460; 172/701.1–701.3; 411/106, 249, 265, 307, 348; 403/374.1, 374.2, 374.4, 379.2, 379.4; 299/109
See application file for complete search history.

(56) References Cited

U.S. PATENT DOCUMENTS

| | | | | |
|---|---|---|---|---|
| 5,435,084 | A | 7/1995 | Immel | |
| 5,913,605 | A * | 6/1999 | Jusselin et al. | 37/451 |
| 7,178,274 | B2 * | 2/2007 | Emrich | 37/453 |
| 7,640,684 | B2 | 1/2010 | Adamic et al. | |
| 7,640,685 | B2 * | 1/2010 | Emrich | 37/457 |
| 7,762,015 | B2 | 7/2010 | Smith et al. | |
| 7,788,830 | B2 | 9/2010 | Woerman et al. | |
| 8,122,623 | B1 | 2/2012 | Hughes | |
| 8,127,476 | B2 * | 3/2012 | Bierwith | 37/455 |

(Continued)

FOREIGN PATENT DOCUMENTS

WO 2004099511 A2 11/2004

OTHER PUBLICATIONS

Examiner's Report for Australian Patent Application No. 2011201408, dated May 26, 2011.

(Continued)

*Primary Examiner* — Robert Pezzuto
(74) *Attorney, Agent, or Firm* — Bachman & LaPointe, P.C.

(57) ABSTRACT

A coupling for connecting ground engaging tools to a lip of an excavator bucket or similar uses an eccentric rotating lock, whereby rotation of the lock alters the distance between bearing surfaces and thus allows tightening of the lock.

31 Claims, 19 Drawing Sheets

(56) References Cited

U.S. PATENT DOCUMENTS

| | | | |
|---|---|---|---|
| 2006/0037219 | A1 | 2/2006 | Robinson et al. |
| 2008/0028644 | A1 | 2/2008 | Lopez Almendros et al. |
| 2008/0148608 | A1 | 6/2008 | Harder et al. |
| 2008/0263913 | A1 | 10/2008 | Briscoe et al. |
| 2010/0162594 | A1 | 7/2010 | Bierwith |

OTHER PUBLICATIONS

Email communication dated Oct. 20, 2011 from IPAU examiner in AU2011201408.

International Search Report for PCT/US2044/011266, dated Mar. 26, 2012.

* cited by examiner

CONNECTION ASSEMBLY

CROSS-REFERENCE TO RELATED APPLICATIONS

This is a 371 US national stage application of PCT/AU2011/001585, filed Dec. 7, 2011, and entitled "Anchor" which is a Continuation-in-Part of U.S. patent application Ser. No. 13/155,472, filed Jun. 8, 2011 and entitled "Anchor" and priority is claimed of AU2010905369, filed Dec. 7, 2010 and AU2011201408, filed Mar. 28, 2011, the disclosures of which are incorporated by reference herein in their entireties as if set forth at length.

FIELD OF THE INVENTION

The present invention relates to the connection of wearing elements to machinery. It is particularly directed to the connection of ground engaging tools such as teeth to excavator buckets, but may have wider application.

BACKGROUND TO THE INVENTION

Buckets of excavating equipment are subject to significant abrasive wear during use. For this reason, replaceable ground engaging tools (GET) are located about the buckets in the areas most susceptible to wear. A number of different GET are used, including heel shrouds, lip shrouds, adaptors, wear plates and, importantly, teeth.

The connection of teeth to adaptors has presented a consistent challenge, and there are many different systems currently available which seek to perform this task in an efficient manner. Many of the systems use a locking pin, which passes through a bore of the adaptor. Such an arrangement has an inherent problem in that the provision of a bore weakens the adaptor, as well as encouraging stress concentrations within the adaptor. In addition, locking pins have a tendency to bend in use, and removal of a bent locking pin may be difficult.

Other systems use a latching system. These are problematic in that there is usually no ability to adjust or tighten the connection, hence the teeth are liable to become loose.

The present invention seeks to provide an arrangement for connection of wearing elements, particularly teeth, which addresses some of these problems.

SUMMARY OF THE INVENTION

According to one aspect of the present invention there is provided a coupling for connecting a wear member to a base, the base including a first bearing surface, the wear member including a second bearing surface; the coupling including a rotatable lock having a first face arranged to bear against the first bearing surface and a second face arranged to bear against the second bearing surface, the relative positions of the first and second face varying around a central axis of the lock, such that in use rotation of the lock alters the distance between the first and second bearing surfaces.

It is preferred that the first face and the second face of the rotatable lock are both arcuate and have respective radii of curvature, with the radius of curvature of at least one of the first or second face varying around the lock central axis. In a preferred embodiment of the invention, the second face of the rotatable lock has a constant radius of curvature; that is, is part-cylindrical; whereas the first face has a varying radius of curvature; that is, is shaped like a spiral.

The wear member may be arranged to align about the base along a longitudinal axis. The central axis of the lock may be perpendicular to this longitudinal axis, but it is preferred that that the central axis of the lock be oriented at about 10° to 20° relative to the perpendicular.

The first face and second face of the rotatable lock may be located on a single bearing member. It is preferred that the bearing member includes a body portion, which is cylindrical, and has an outer surface forming the second face of the rotatable lock. It is also preferred that the bearing member has an engaging portion protruding from one side of the body portion, the engaging portion having an outer surface, at least a part of which forms the first face of the rotatable lock.

The engaging portion may be formed from an introductory portion, which may include a substantially straight outer edge, joined to a spiralling portion. The engaging portion may be generally annular, with an outside wall and an inside wall. In this arrangement the outside wall of the spiralling portion forms the first face of the rotatable lock.

The height of the engaging portion relative to the body portion may vary around the annulus. It is preferred that the height of the spiralling portion be a minimum at one end of the introductory portion, and at a maximum at a location on the spiralling portion which is located on a line which is perpendicular to the introductory portion and which passes through the central axis of the lock.

The bearing member may be coupled to an operable member. In a preferred embodiment, the operable member includes a keyed projection which engages with a keyed recess in the bearing member.

It is preferred that the rotatable lock is retained within the wear member. The wear member may have an internal cavity, with an aperture passing through a side wall of the wear member into the cavity, and the lock being receivable within the cavity. It is preferred that the cavity includes an inner region in which the bearing member can be received, the inner region including the second bearing face, and an outer region in which the operable member can be received. In a preferred embodiment of the invention, the inner and outer regions are separated by a toothed ring, arranged to engage with a toothed ring located about the rotatable lock. At least one of the toothed rings is resilient, such that engagement of the respective teeth will maintain the lock in a desired angular position, but whereby the application of an angular force to the operable member will cause deformation of the resilient toothed ring to allow rotation of the lock.

In a preferred embodiment of the invention, the operable member includes a tool-receiving recess in which is located a plug formed at least partially of resilient material. The arrangement is such that insertion of a tool within the tool-receiving recess causes compression of the plug, and removal of the tool allows return of the plug to its uncompressed state.

The base may include a side wall having a recess, the recess having an arcuate wall which forms the first bearing surface. It is preferred that the recess be generally tapered towards the arcuate wall. The recess may include a boss spaced from the arcuate wall, the boss being arranged to engage with the inside wall of the engaging portion of the bearing member in some angular positions, to promote disengagement of the wear member from the base during removal.

The wear member may be an excavator tooth, and the base may be an adaptor. In this embodiment, it is preferred that the adaptor includes a nose having a top and a bottom, each of the top and the bottom including two substantially flat bearing surfaces separated by concave joining surfaces.

The excavator tooth has a cavity substantially complementary in shape to the adaptor nose, having substantially flat bearing surfaces separated by convex joining surfaces. The convex joining surfaces of the tooth have curvature slightly less than the concave joining surfaces of the adaptor nose.

In accordance with a second aspect of the present invention there is provided a coupling for connecting a wear member to a base, the base including a first bearing surface, the wear member including a second bearing surface; the coupling including a rotatable lock having a first face arranged to bear against the first bearing surface and a second face arranged to bear against the second bearing surface, the lock having a central axis about which it can be rotated, the first and second face being both axially and circumferentially spaced relative to central axis of the lock, such that in use the lock can be rotated between a position in which the first and second face bear against the first bearing surface and second bearing surface respectively, and a position in which the first face does not bear against the first bearing surface or the second face does not bear against the second bearing surface. This allows for selective engagement and disengagement of the lock by virtue of turning. Although in a preferred embodiment the present invention allows for tightening of the lock, it will be appreciated that in its simplest form the invention may simply act as a latch to engage the coupling.

In accordance with a third aspect of the present invention there is provided a coupling for connecting a wear member to a base, the coupling including a lock having at least two positions: a locked position whereby the wear member is restrained from moving relative to the base and an unlocked position in which the wear member is able to move relative to the base in an unrestrained manner, and wherein moving the lock from the locked position to the unlocked position urges the wear member away from the base.

It is preferred that the lock be rotatable, and that the two positions correspond to two angularly spaced positions of the lock, and that rotation of the lock from the locked position to the unlocked position causes movement of the wear member relative to the base. The movement of the wear member is preferably translational, and may be radial relative to the lock rotation.

In a fourth aspect of the invention the lock of the third aspect functions simply as a release mechanism for the wear member, rather than as a lock. In accordance with this fourth aspect of the invention there is provided a release mechanism for a wear member mounted onto a base, the release mechanism having at least two positions: a first position in which the wear member is able to be coupled to the base, and a second position in which the release mechanism urges the wear member away from the base.

It is preferred that the release mechanism be rotatable, and that the two positions correspond to two angularly spaced positions of the release mechanism, and that rotation of the release mechanism from the first position to the second position causes movement of the wear member relative to the base. The movement of the wear member is preferably translational, and may be radial relative to the release mechanism rotation.

In accordance with a fifth aspect of the present invention there is provided a lock for coupling a wear member to a base, the lock including a hollow for engagement with a tool, wherein a plug is contained within the hollow, the plug being resiliently compressible such that a tool can engage with the hollow by compressing the plug. When the tool is removed, the plug can return to its original configuration. In this way, the ingress of dust and particulate matter into the hollow is substantially impeded.

BRIEF DESCRIPTION OF THE DRAWINGS

It will be convenient to further describe the invention with reference to preferred embodiments of the coupling mechanism of the present invention. Other embodiments are possible, and consequently the particularity of the following discussion is not to be understood as superseding the generality of the preceding description of the invention. In the drawings:

FIG. 9(*b*) is a cross section through line P-P marked on FIG. 9*a;*

FIG. 14(*b*) is a cross section through line D-D marked on FIG. 14(*a*);

FIG. 14(*c*) is a cross section through line E-E marked on FIG. 14(*a*);

FIG. 14(*d*) is a cross section through line F-F marked on FIG. 14(*a*);

FIG. 14(*e*) is a cross section through line G-G marked on FIG. 14(*a*);

FIG. 14(*f*) is a cross section through line H-H marked on FIG. 14(*a*);

FIG. 14(*g*) is a cross section through line I-I marked on FIG. 14(*a*);

FIG. 14(*h*) is a cross section through line J-J marked on FIG. 14(*a*);

FIG. 15(*b*) is a rear view of the tooth of FIG. 15*a*, shown with the lock in place;

FIG. 24(*a*) is an exploded view of a portion of the lock of FIG. 10;

DETAILED DESCRIPTION OF PREFERRED EMBODIMENTS

Figure 1:
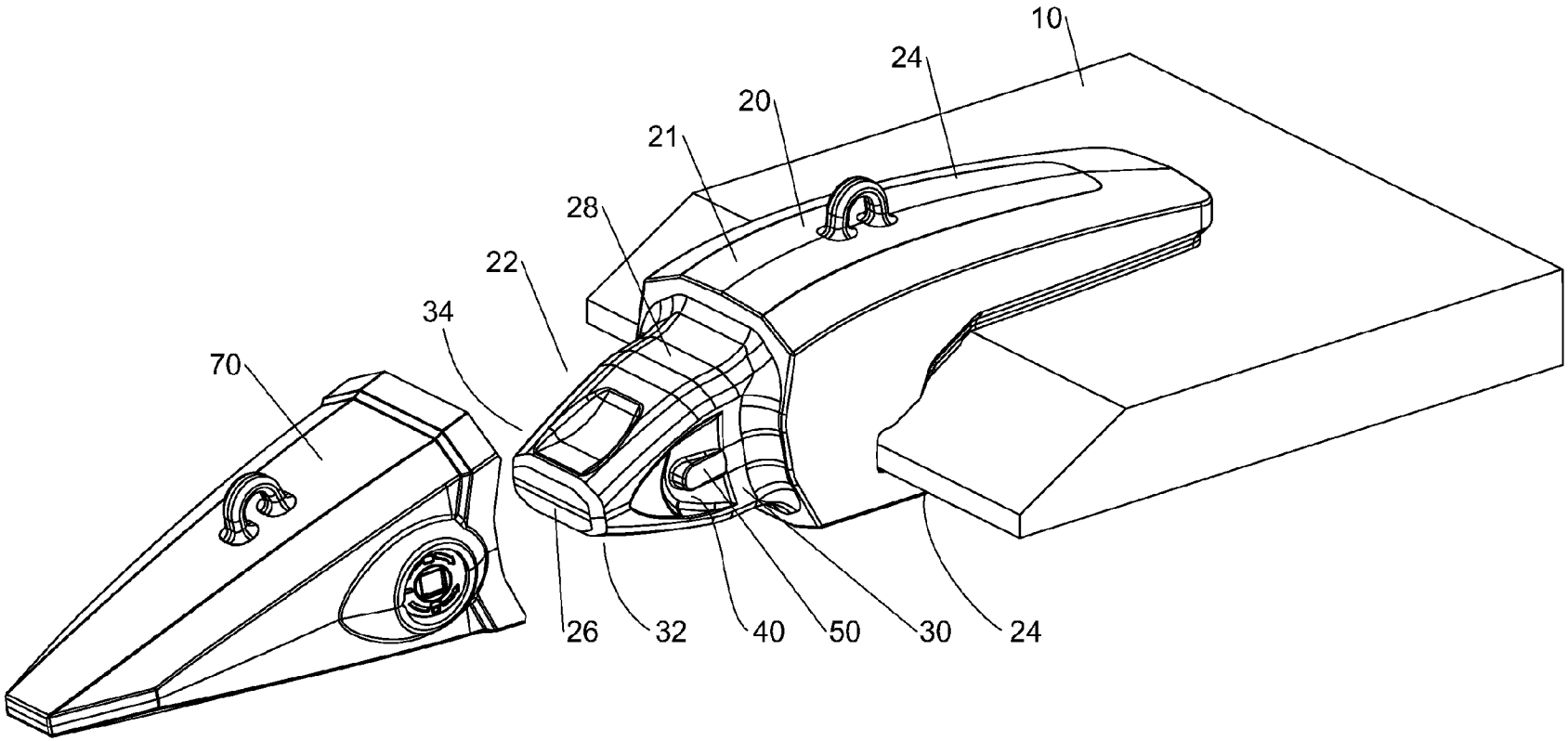
FIG. 1 is a perspective of an adaptor and tooth having a coupling in accordance with the present invention, shown prior to coupling.
Figure 2:
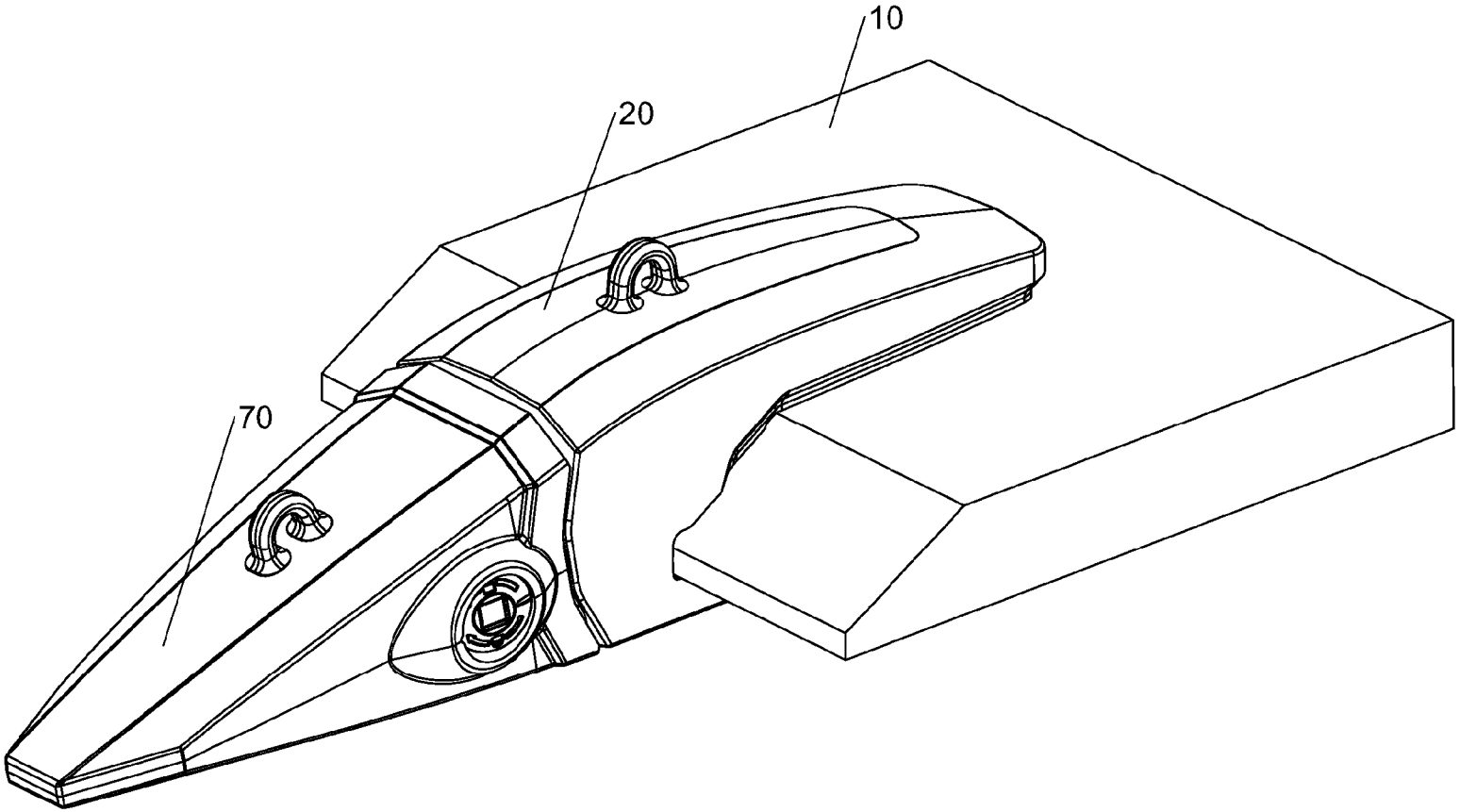
FIG. 2 is a perspective of the adaptor and tooth of FIG. 1 shown coupled.

Referring to the Figures, FIG. 1 shows a portion of a lip 10 of an excavator bucket, onto which is located an adaptor 20. A tooth 70 is shown ready for attachment to the adaptor 20.

The adaptor 20 has a body part 21; a nose 22 extending forwardly of the body part 21 onto which the tooth 70 can be located, and two legs 24 extending rearwardly of the body part 21 about the lip 10.

Figure 3:
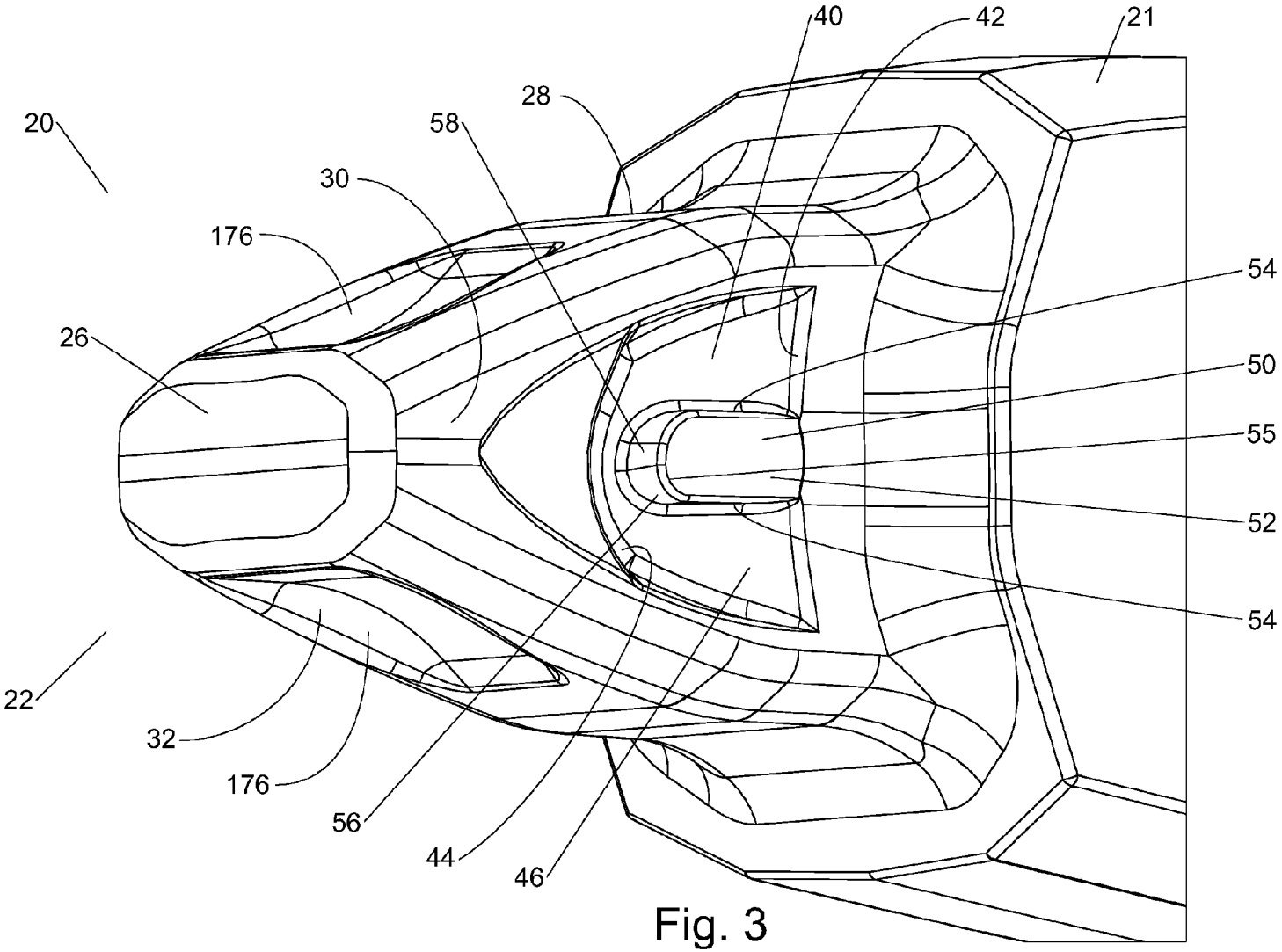
FIG. 3 is a front perspective of a nose of the adaptor of FIG. 1, showing a first side.
Figure 4:
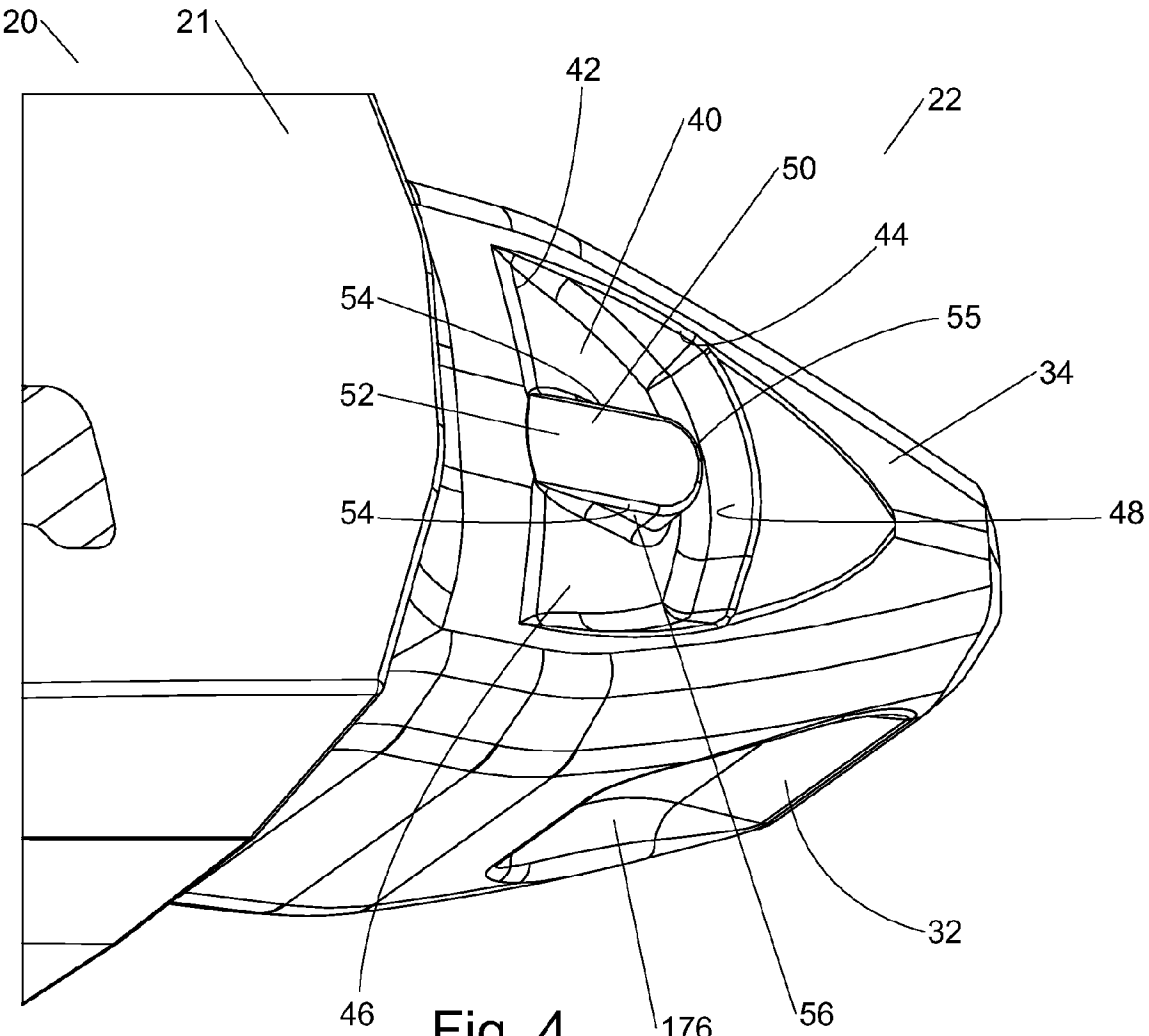
FIG. 4 is a rear perspective of the adaptor nose of FIG. 3, showing a second side.
Figure 5:
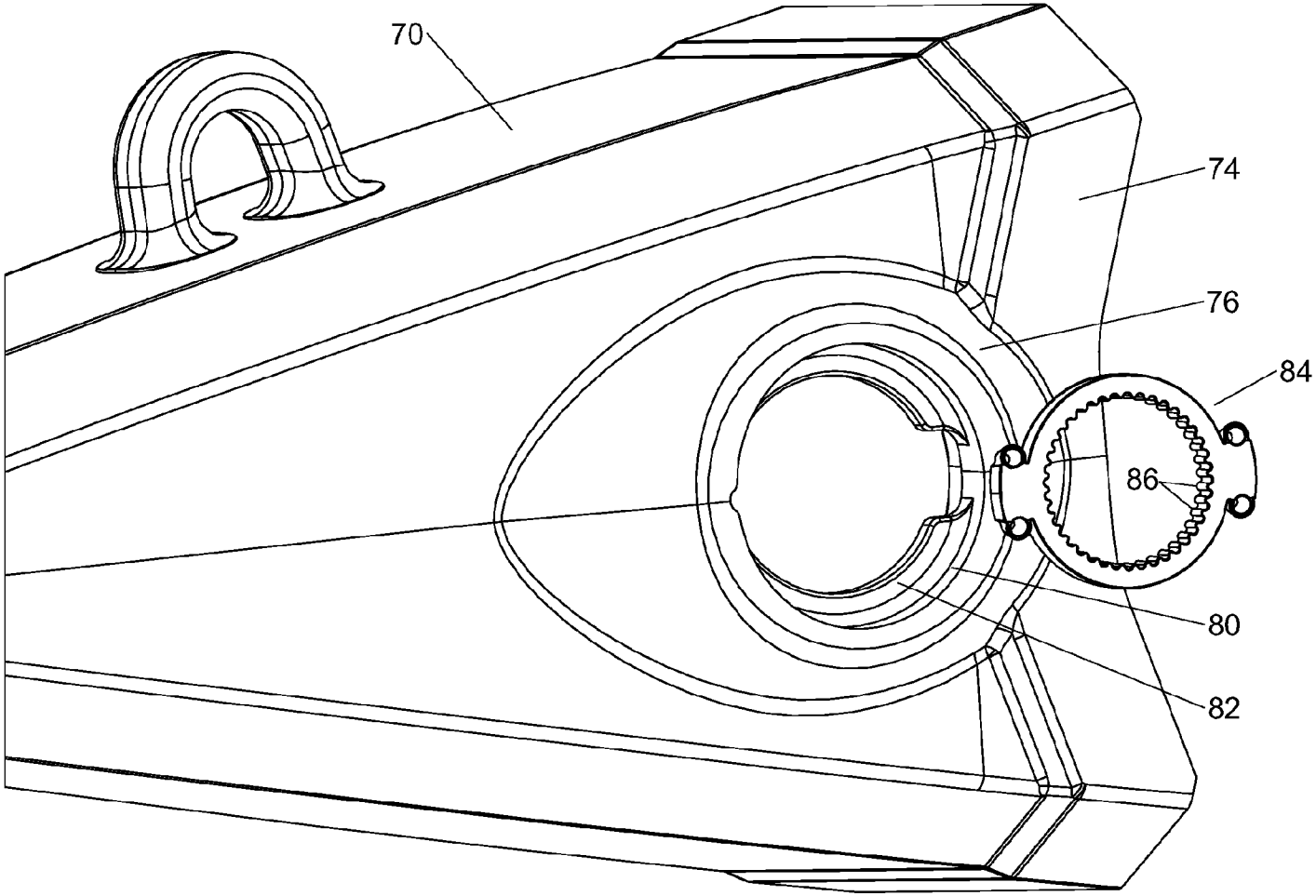
FIG. 5 is an external view of a lock-receiving aperture in the tooth of FIG. 1, shown prior to receiving a toothed ring.
Figure 6:
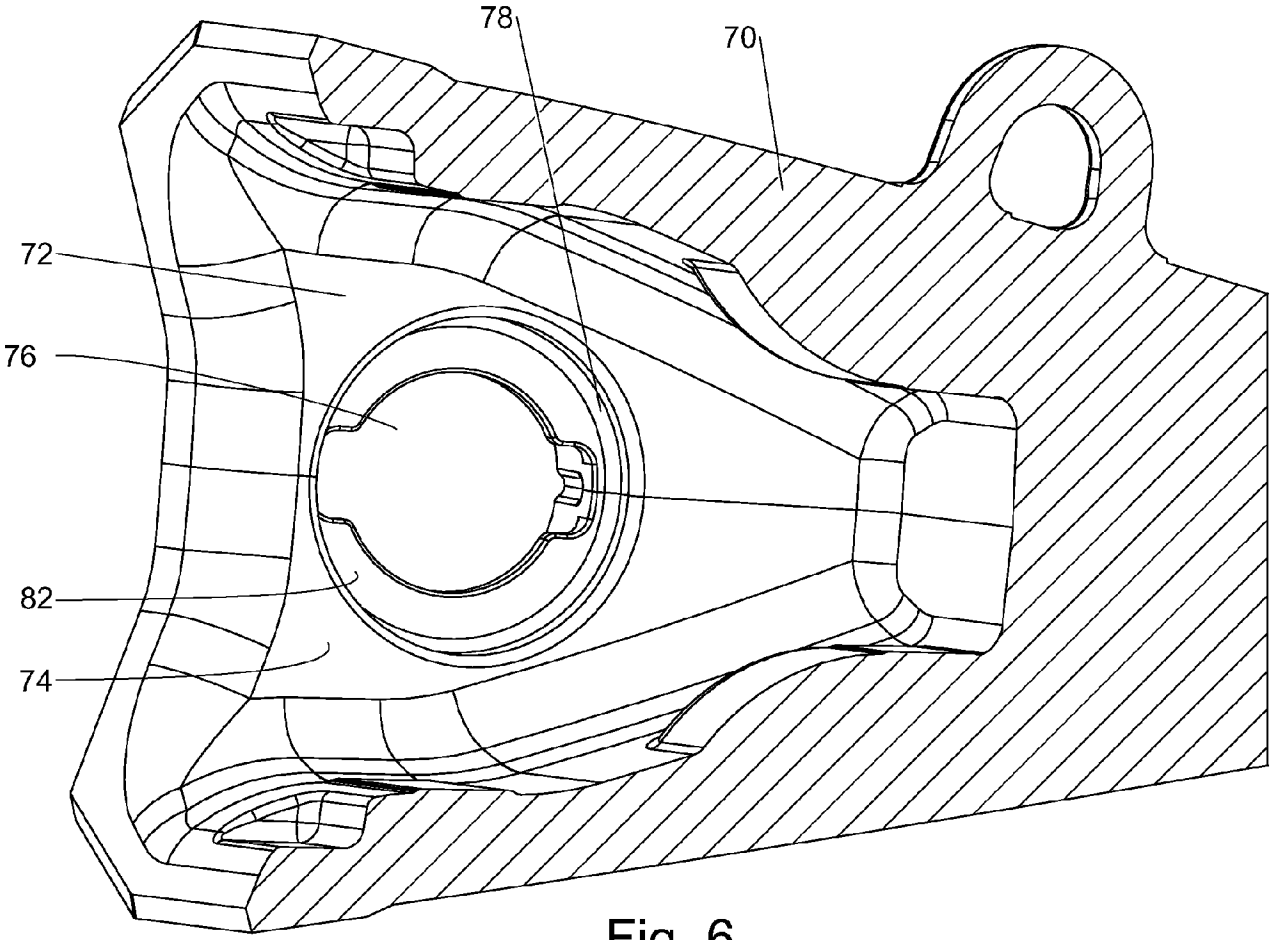
FIG. 6 is an internal view of the lock-receiving aperture of FIG. 5.

The nose 22 can be more clearly seen in FIGS. 3 and 4. It has a front wall 26, a top 28, a first side wall 30, a bottom 32, and a second side wall 34. The top 28 and the bottom 32 each extend from the body part 21 to the front wall 26. The top 28 and the bottom 32 are not parallel, but are generally angled towards each other such that the nose 22 reduces in height towards the front wall 26, with the front wall 26 being about half the height of the body part 21.

The first and second side walls 30, 34, each extend from the body portion 21 to the front wall 26. The first and second side walls 30, 34 are each stepped in from the body portion 21, but thereafter are generally parallel towards the front wall 26. The top 28, bottom 32 and front wall 26 are thus all generally rectangular, whereas the first and second side walls 30, 34 are generally trapezoid.

The precise shapes of these surfaces will be discussed further below.

The first side wall 30 and the second side wall 34 each include a recess 40. The recess 40 has a rear edge 42, which is generally parallel to the rearmost part of the respective side wall 30, 34, and an arcuate front edge 44, which extends from either end of the rear edge 42 towards the front wall 26.

The recess 40 is generally tapered, such that it increases in depth towards the front wall 26. The recess 40 has a base 46, which is part frusto-conical in shape, the cone axis being nearly perpendicular to the side wall 30, 34 and being located towards the rear edge 42, and the cone angle being extremely shallow. In the embodiment shown, the cone axis is actually about 11° away from the perpendicular, with an outer end of the axis closer to the front wall 26 than an inner end. The base 46 is thus slightly convex. The rear of the base 46, which is the rear edge 42, is substantially level with the side wall 30, 34. The front of the base 46, which is located beneath the centre of the front edge 44, is inwardly spaced from the side wall 30, 34. An arcuate recess wall 48 extends between the front edge 44 and the base 46. The recess wall 48 is oriented at about 75° to the side wall 30, 34. The height of the recess wall 48 thus tapers from zero at its outer edges, at the ends of the rear edge 42, to a maximum height at the centre of the front edge 44.

Each side wall 30, 34 also includes a locating boss 50. The boss 50 is located within the recess 40, and has an outer face 52. The outer face 52 is generally rectangular with parallel upper and lower edges 54 extending from the rear edge 42 of the recess 40 towards the front wall 26. The outer face 52 is slightly convex, with the upper and lower edges 54 being parallel to a central axis of the adaptor nose 22 and being level with the rear edge 42, and a centre line of the outer face 52 protruding slightly higher.

The outer face 52 has a front edge 55. The corners between the front edge 55 and the upper and lower edges 54 are radiussed, with a radius of curvature about one-third of the length of the front edge 55. The boss 50 has a side wall 56 which is generally perpendicular to the outer face 52, and extends between the outer face 52 and the recess base 46. The side wall 56 consists of two flat triangular portions beneath the upper and lower edges 54, a rectangular front portion 58, and two part-conical joining portions. The front portion 58 is spaced from a front-most part of the recess wall 48.

The tooth 70 has an internal cavity 72 which is generally complementary in shape to the nose 22 of the adaptor 20. The tooth 70 has a first side wall 74 which locates over the first side wall 30 of the nose 22.

A lock-receiving aperture 76 extends through the first side wall 74 between an outside surface of the tooth 70 and the internal cavity 72. The aperture 76 is generally circular, and arranged to align with the recess 40 when the tooth 70 is located about the adaptor 20. The lock-receiving aperture 76 is shown in detail in FIGS. 5 to 9.

The aperture 76 is not perpendicular to the first side wall 74, but is in fact oriented at an angle of about 10° to 15° toward the rear of the cavity 72. This can be most clearly seen in FIG. 9.

The lock-receiving aperture 76 has three parts: a tooth recess 78 extending into the first side wall 74 from the internal cavity 72; a lock-locating recess 80 extending into the first side wall 74 from the outside surface of the tooth 70; and a ring-receiving portion 82 located between the tooth recess 78 and the lock-locating recess 80. The tooth recess 78 and the lock-locating recess 80 are both circular, being coaxial and of similar diameter. The ring-receiving portion 82 is substantially circular, and is of smaller diameter than the tooth recess 78 and lock-locating recess 80. The aperture 76 therefore has a stepped configuration.

Figure 7:
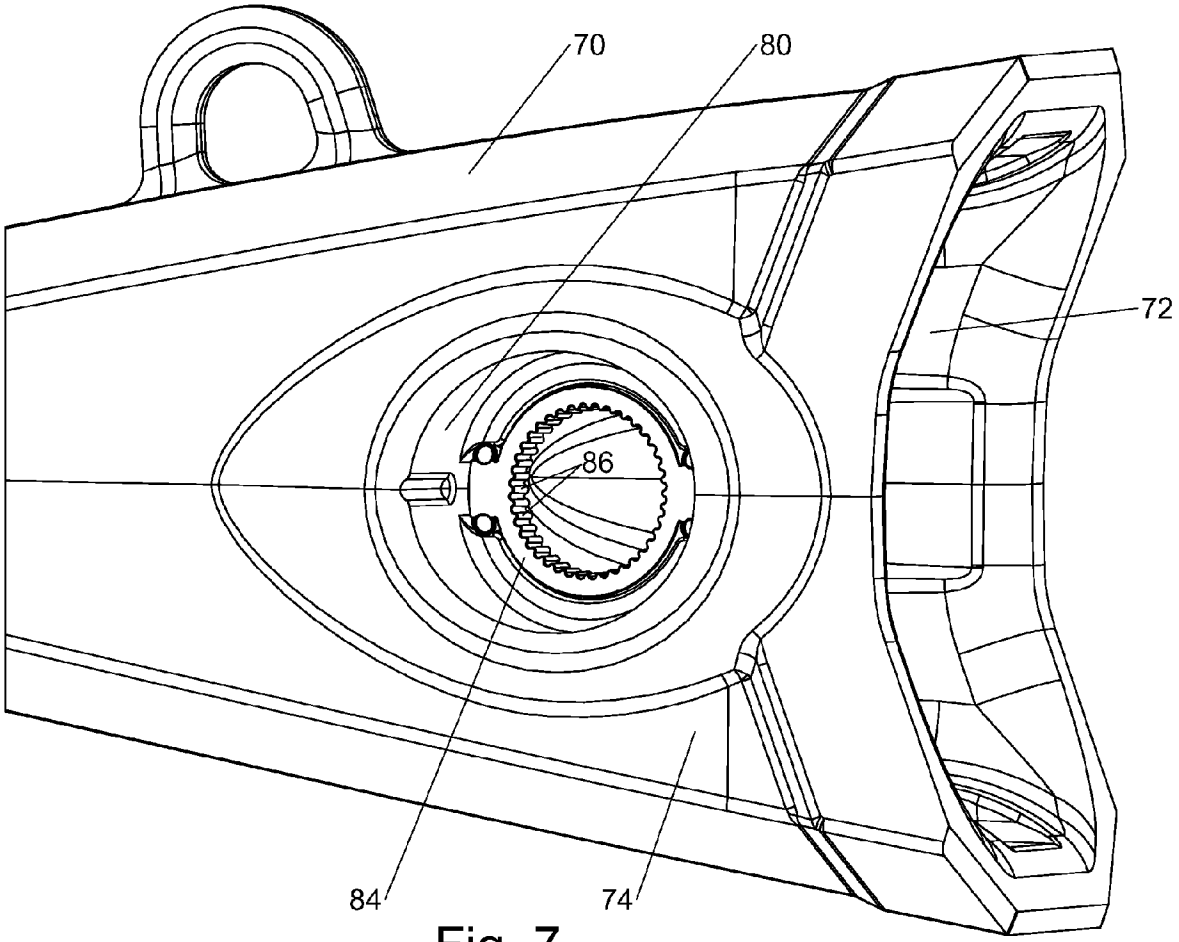
FIG. 7 is an external view of the lock-receiving aperture of FIG. 5, shown with the toothed ring inserted.
Figure 8:
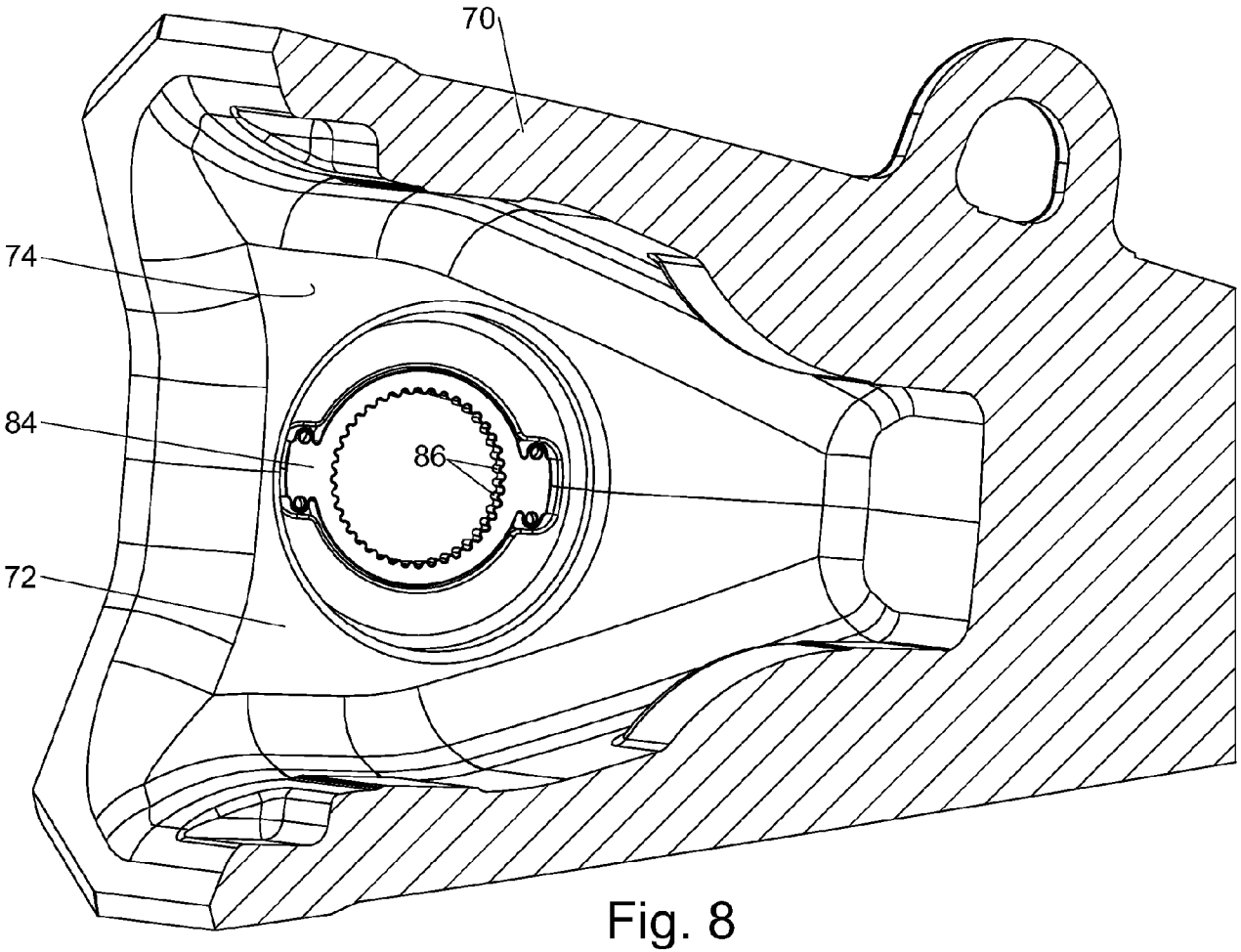
FIG. 8 is an internal view of the lock-receiving aperture of FIG. 7.
Figure 9A:
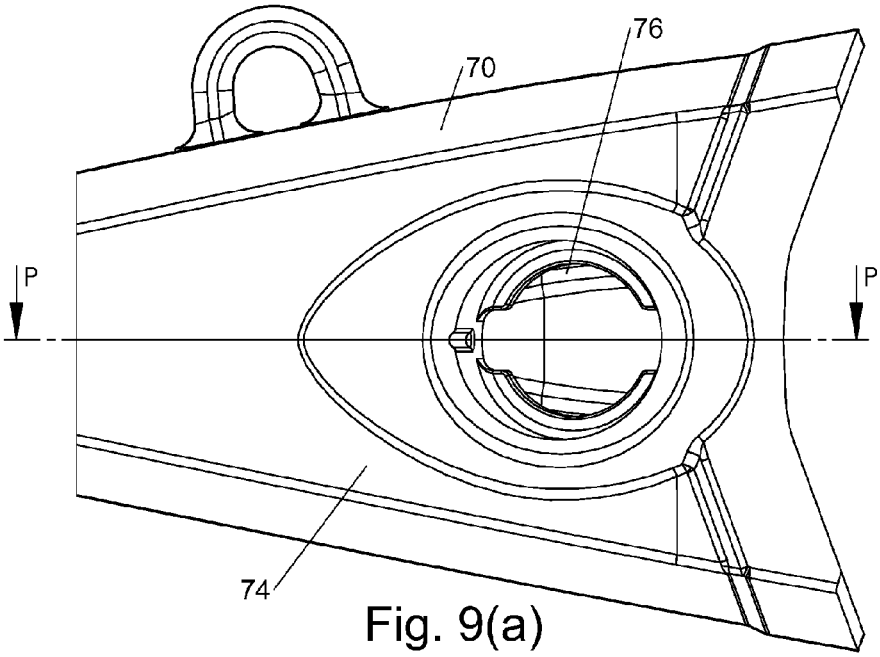
FIG. 9(*a*) is a side view of the lock-receiving aperture of FIG. 5.
Figure 9B:
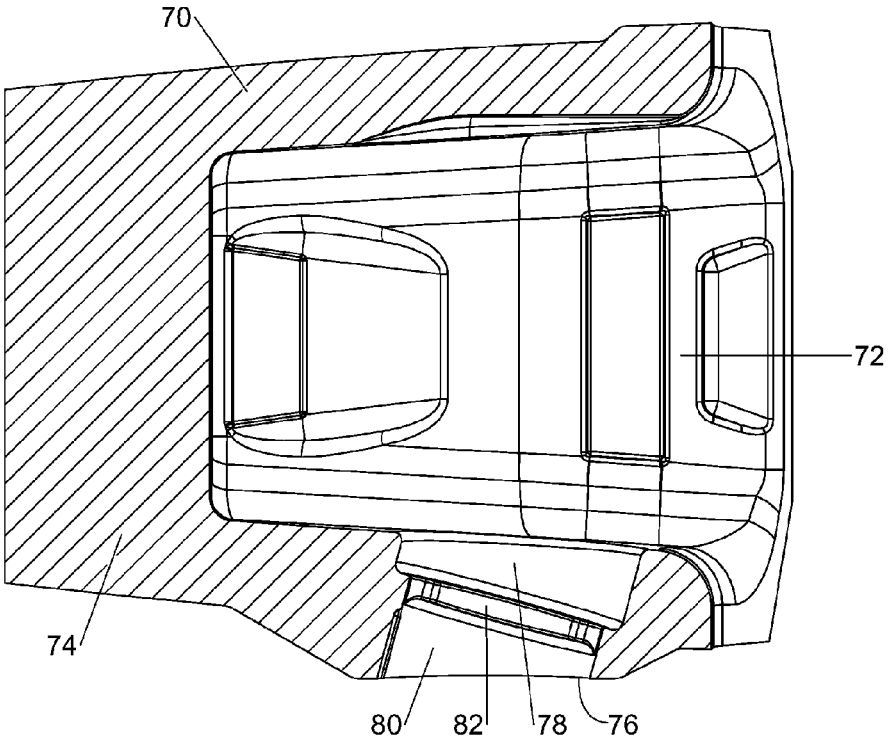

The ring-receiving portion 82 has a number of keyed apertures around its periphery, in order to securely receive a toothed ring 84 within. The toothed ring 84, which may be made of aluminium or a hard plastic, has a generally circular internal surface formed by a plurality of retaining teeth 86. The toothed ring 84 has outer keyed projections sized and shaped to be press fitted into the ring receiving portion 82 of the aperture 76. When the toothed ring 84 is thus fitted within the aperture 76, as shown in FIG. 7, the teeth 86 define the separation between the tooth recess 78 and the lock-locating recess 80.

Figure 11:
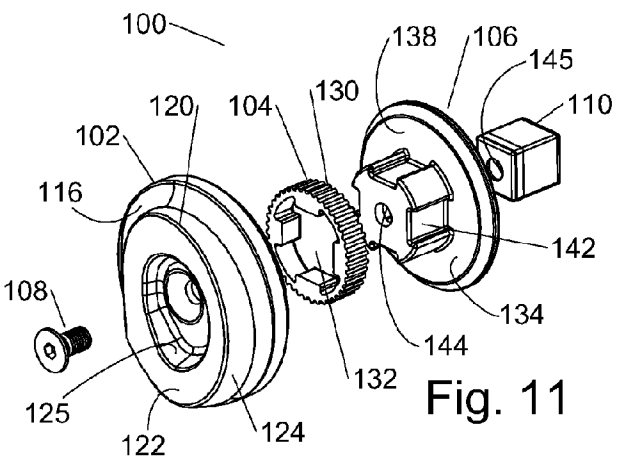
FIG. 11 is an exploded view of the lock of FIG. 10, viewed from the inside.
Figure 10:
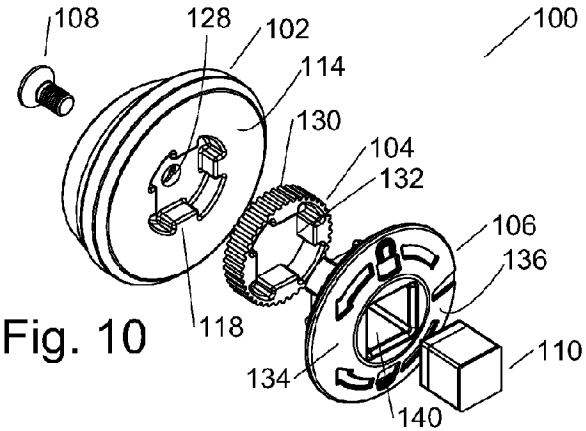
FIG. 10 is an exploded view of a lock from the coupling of FIG. 1, viewed from the outside.

The tooth 70 is coupled to the nose 22 of the adaptor 20 by means of a lock 100. The lock 100 can be seen in FIGS. 10 and 11.

The lock 100 includes a bearing member 102, a toothed engaging ring 104, and an operable member 106. The lock 100 also includes a screw 108 and a plug 110.

Figure 12:
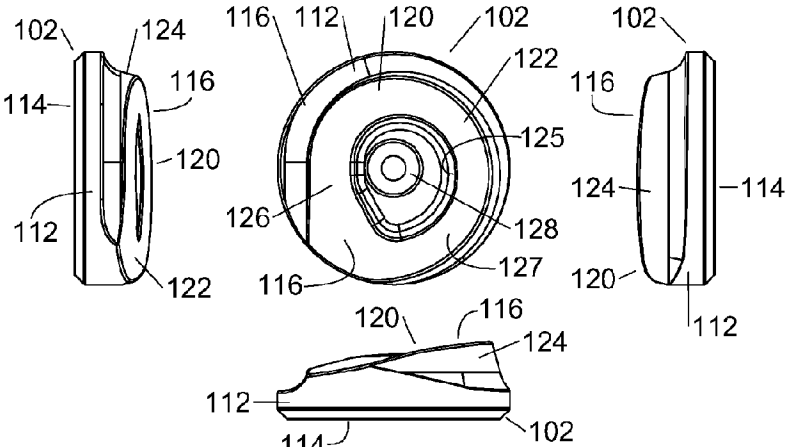
FIG. 12 is a set of side and plan views of a bearing member within the lock of FIG. 10.
Figure 14A:
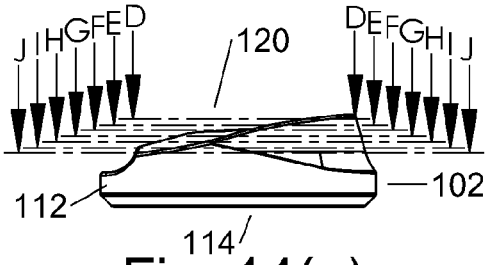
FIG. 14(*a*) is a side view of the bearing member of FIG. 12.
Figure 14B:
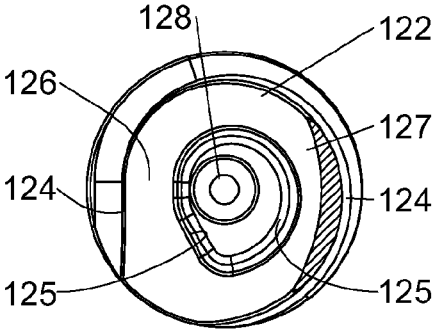
Figure 14C:
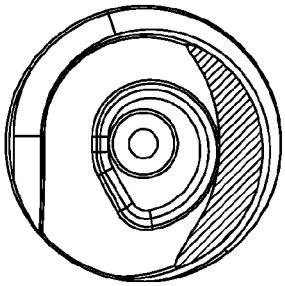
Figure 14D:
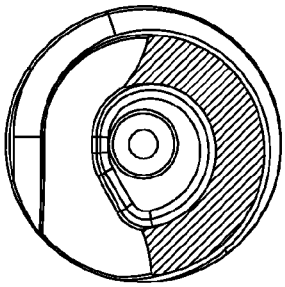
Figure 14E:
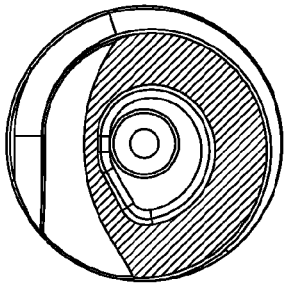
Figure 14F:
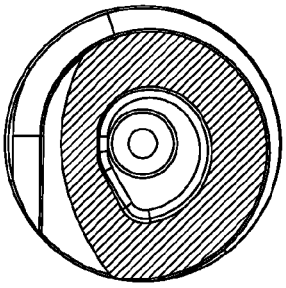
Figure 14G:
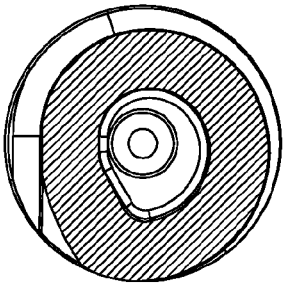
Figure 14H:
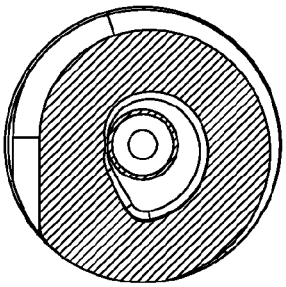

The bearing member 102, which is shown in FIG. 12, has a generally cylindrical body portion 112 sized to locate within the tooth recess 78 of the tooth 70. The body portion 112 has a first side 114 oriented, in use, towards the outside of the tooth 70; and a second side 116 oriented, in use, towards the cavity 72.

The first side 114 includes a centrally positioned, keyed recess 118 extending into the body portion 112.

An engaging portion 120 is located on the second side 116, extending outwardly from the body portion 112.

The engaging portion 120 has a generally annular outer face 122, which is angled relative to the sides 114, 116 of the body portion 112. The engaging portion 120 thus has an outside wall 124 and an inside wall 125 which extend at an angle of about 75° to 80° from the second side 116 of the body portion 112, the outside wall 124 and inside wall 125 both extending between the second side 116 of the body portion 112 and the outer face 122. The height of the outside wall 124 and inside wall 125 vary circumferentially about the outer face 122.

Although the outer face 122 has been described as generally annular, the annulus is not circular. It includes an introductory portion 126, the introductory portion having an outer edge (that is, part of the outside wall 124) including both a part-cylindrical portion, having a radius close to the radius of the body portion 112 and a substantially straight portion. The outer face 122 also includes a spiralling portion 127 which gradually increases in radius through about 300°, from a minimum radius where it joins the substantially straight edge portion of the introductory portion 126, to a maximum radius where it joins the part-cylindrical portion of the introductory portion 126. The height of the outside wall 124 and the inside wall 125 are at a minimum at the part-cylindrical portion of the introductory portion. The height of the outside wall gradually increases along the introductory portion 126 and then the spiralling portion 127, reaching a maximum height at a location about 215° around the annulus from the minimum height portion. The height then decreases through the remaining 135° of the spiralling portion 127. This can be seen through consideration of the sequential cross sections of FIG. 14.

It will also be observed that the outside wall 124 and inside wall 125 are not the same height, with the outside wall 124 being higher than the inside wall around the spiralling portion 127 and the inside wall being higher than the outside wall along the introductory portion 126.

A screw receiving aperture 128 passes centrally through the body portion 112, inside the annulus of the engaging portion 120. The screw receiving aperture 128 is countersunk on the second side 116 of the body portion 112, again inside the annulus of the engaging portion 120.

The toothed engaging ring 104 has engaging teeth 130 arranged about its outside, sized to engage with the retaining teeth 86 of the toothed ring 84. The toothed engaging ring 104 is formed from a resilient material such as rubber.

The toothed engaging ring 104 has a keyed central aperture 132 which corresponds with the keyed recess of the bearing member 102.

Figure 13:
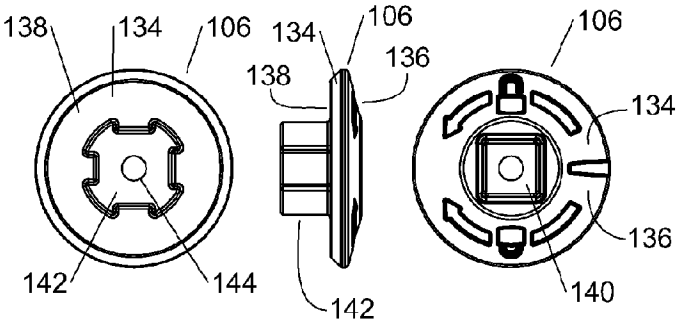
FIG. 13 is a set of side and plan views of an operable member within the lock of FIG. 10.

The operable member 106, best seen in FIG. 13, has a generally cylindrical body portion 134 sized to locate within the lock-locating recess 80 of the tooth 70. The body portion 134 has a first side 136 oriented, in use, towards the outside of the tooth 70; and a second side 138 oriented, in use, towards the cavity 72.

The first side 136 includes a centrally positioned, square-sided hollow or recess 140 extending into the body portion 134.

A keyed projection 142 is located on the second side 138, extending outwardly from the body portion 134. The keyed projection 142 is sized and shaped to engage with both the central aperture 132 of the engaging ring 104 and the keyed recess 118 of the bearing member 102. The keyed projection 142 includes a centrally located screw receiving aperture 144.

The plug 110 is square sided, and arranged to be located within the square-sided recess 140. The plug 110 is formed of a resilient material fixed to a rigid base plate. The base plate includes an internally threaded screw engaging aperture 145.

The arrangement is such that the engaging ring 104 and the bearing member 102 can be fitted in turn on the keyed projection 142 of the operable member 106, and these three elements of the lock 100 can be held together by the screw 108 passing through respective receiving apertures 128, 144 and being screwed into screw engaging aperture 145. It will be appreciated that the keyed arrangement prevents relative rotation, and the screw 108 clamps the components together to prevent relative axial movement. It is also noted that the engaging ring 104, being rubber, may be vulcanised to the operable member 106.

Figure 15A:
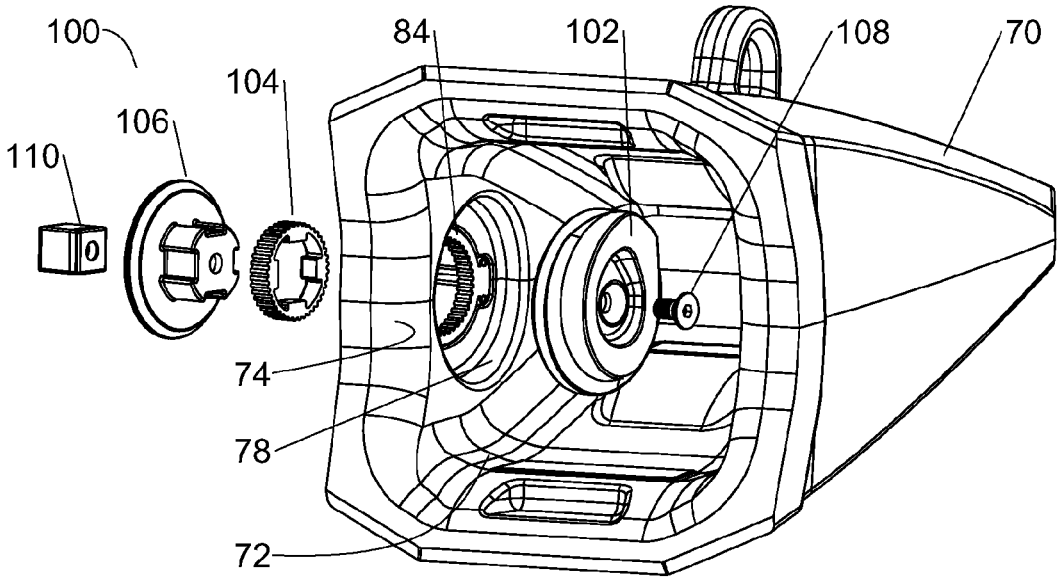
FIG. 15(*a*) is a rear view of the tooth of FIG. 1, shown receiving the lock of FIG. 10.
Figure 15B:
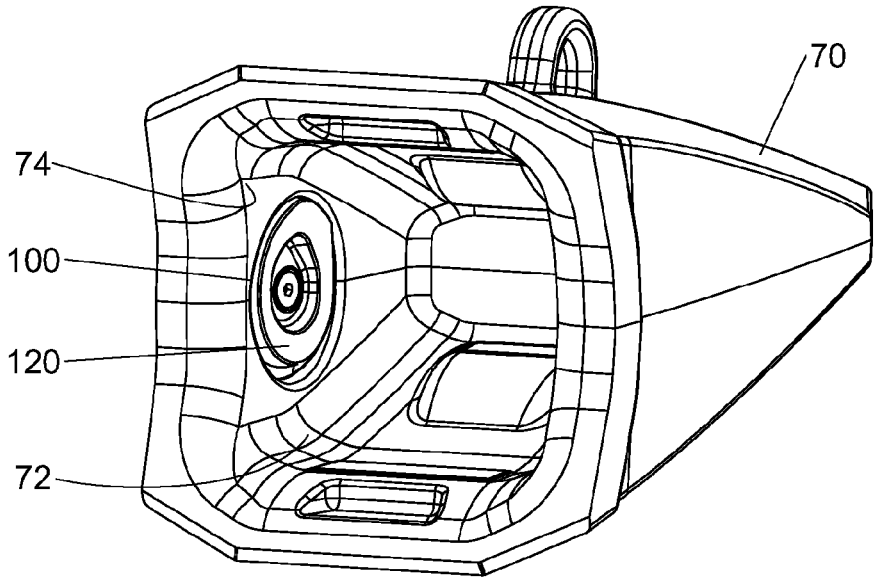
Figure 18:
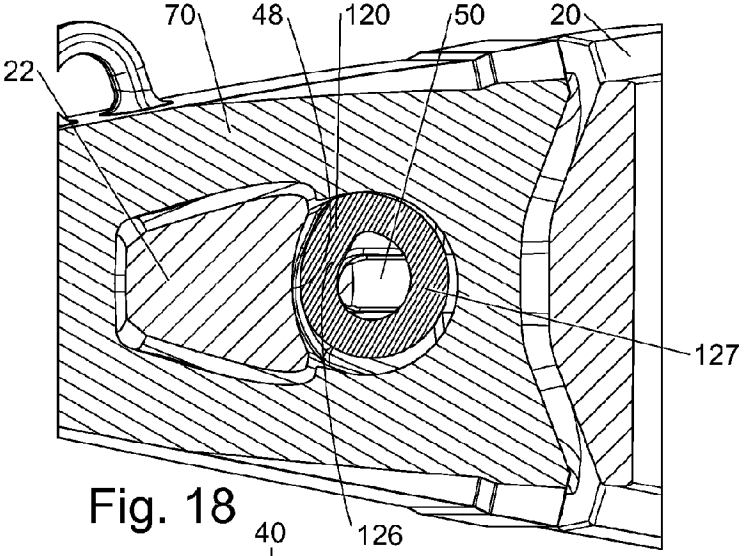
FIG. 18 is a cross section through line O-O marked on FIG. 17.
Figure 19:
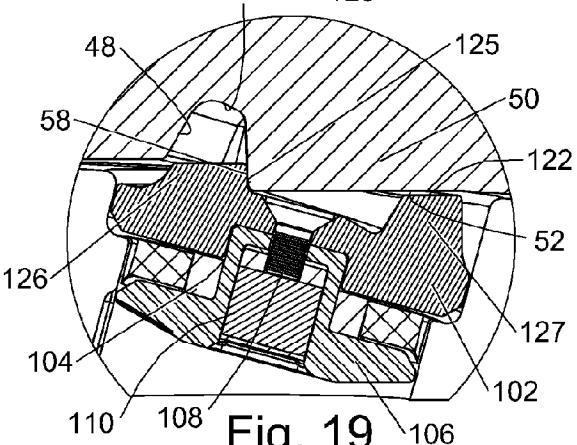
FIG. 19 is an enlargement of a portion of FIG. 17 showing the lock of FIG. 10.
Figure 16:
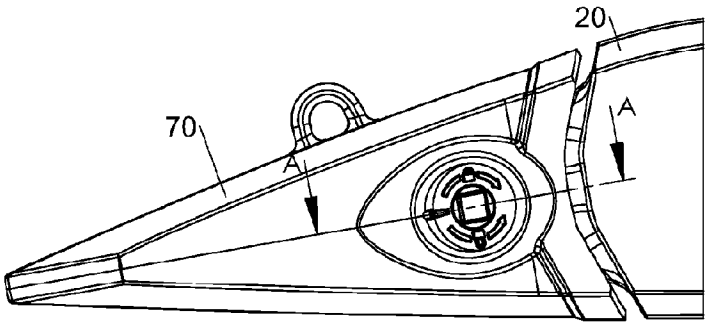
FIG. 16 is a side view of the adaptor and tooth of FIG. 1 during coupling.
Figure 17:
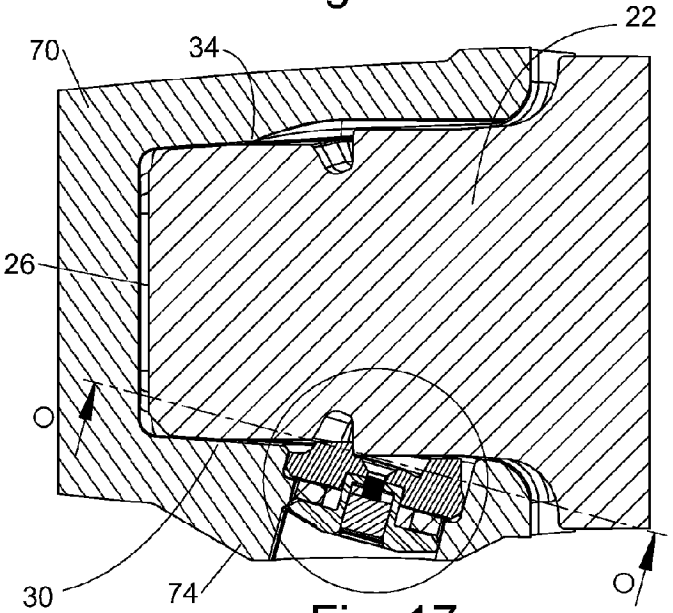
FIG. 17 is a cross section through line A-A marked on FIG. 16.
Figure 22:
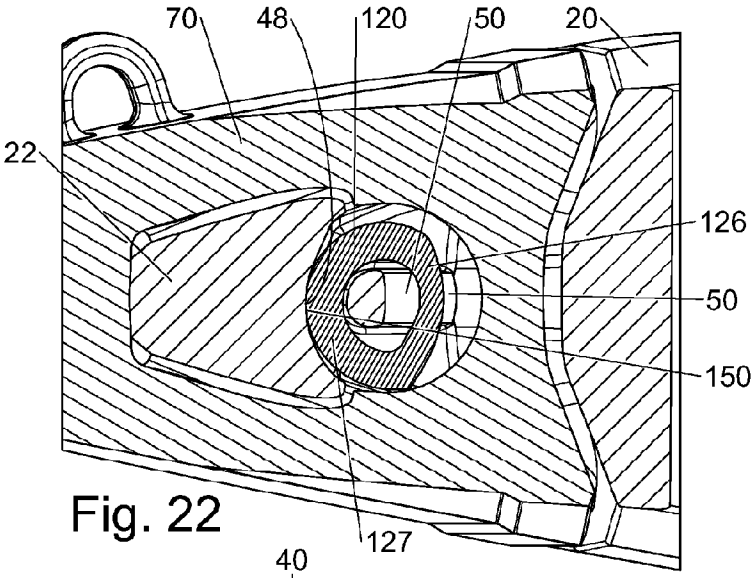
FIG. 22 is a cross section through line K-K marked on FIG. 21.
Figure 23:
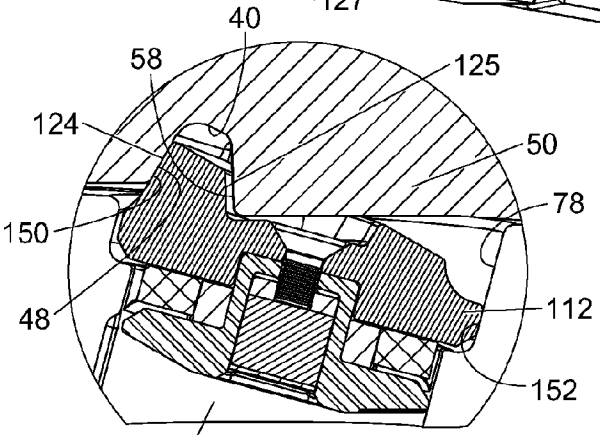
FIG. 23 is an enlargement of a portion of FIG. 21 showing the lock of FIG. 10.
Figure 20:
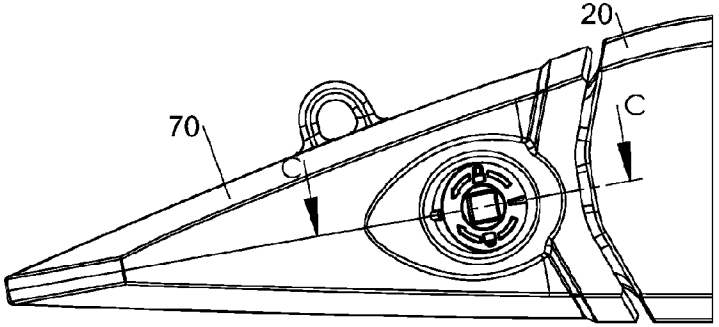
FIG. 20 is a side view of the adaptor and tooth of FIG. 1 following coupling.
Figure 21:
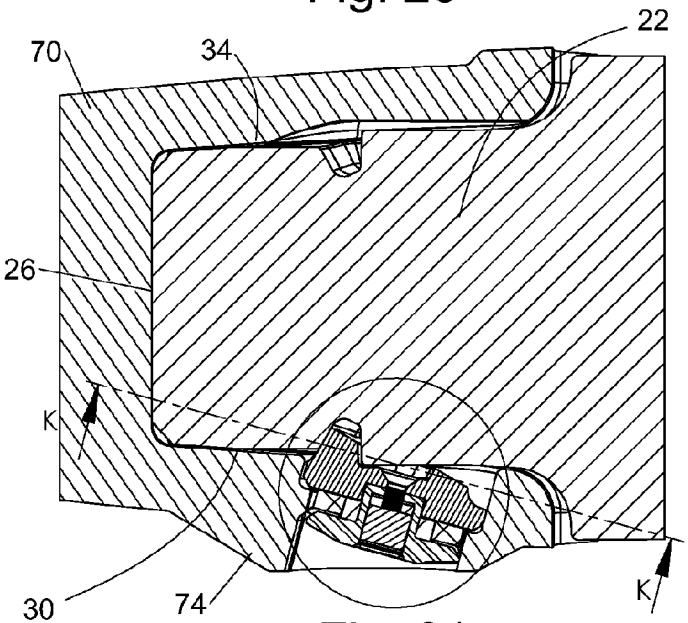
FIG. 21 is a cross section through line C-C marked on FIG. 20.
Figure 24A:
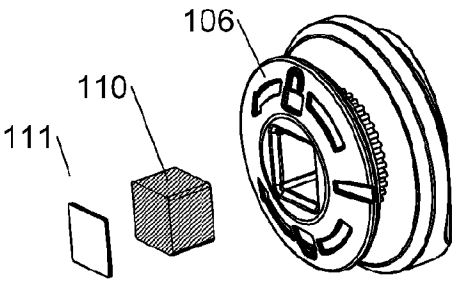
FIG. 24 is a perspective of a driving tool being used to operate the coupling of FIG. 1.

The lock 100 can be fitted into the tooth 70 as shown in FIGS. 15(*a*) and 15(*b*), with the bearing member 102 inserted from the cavity 72 and the operable member 106 inserted from outside the tooth 70.

Operation of the lock 100 in coupling the tooth 70 to the adaptor nose 22 will now be described.

To prepare the coupling for use, the lock 100 is rotated within the tooth aperture 76 to a position whereby the introductory portion 126 of the engaging portion 120 is oriented towards the front of the tooth 70. This means that the outer face 122 of the engaging portion 120 is generally parallel to the inside of the tooth side wall 74, as the maximum height region of the engaging portion 120 is located within the portion of the tooth recess 78 which extends furthest inward from the inside wall.

The tooth 70 can now be slid over the adaptor nose 22, to the position shown in FIGS. 16 to 19. In this position the highest part of the outer face 122 of the engaging portion 120 locates adjacent a rear part of the outer face 52 of the boss 50 of the adaptor nose 22. A portion of the inside wall 125 of the engaging portion 120 adjacent to the introductory portion 126 abuts and bears against the front portion 58 of the side wall 56 of the boss 50.

Clockwise rotation of the lock 100 causes movement of the engaging portion 120 relative to the adaptor recess 40. Due to the increasing radius of the spiralling portion 127, as the lock 100 is rotated the inside wall 125 of the engaging portion 120 ceases to bear against the boss 50, but the outside wall 124 of the engaging portion 120 bears against the recess wall 48. The higher part of the engaging portion 120 moves into the recess 40, thus increasing the contact bearing area between the outside wall 124 and the recess wall 48.

Rotation of the lock 100 through 180° is shown in FIGS. 20 to 23. In this position the lock 100 firmly holds the tooth 70 relative to the adaptor 20. In particular, the outside wall 124 of the engaging portion 120 is a first face of the lock 100, bearing against a first bearing surface 150 being the recess wall 48 of the adaptor 20; and the outer periphery of the body portion 112 of the bearing member 102 is a second face of the lock 100, bearing against a second bearing surface 152 being the tooth recess 78 of the tooth 70.

It will be appreciated that the arrangement is such that the lock tightens against both first and second bearing surfaces 150, 152 without necessarily requiring 180° rotation.

When removal of the lock 100 is required, the lock 100 can be rotated in the opposite direction. When the inside wall 125 comes into contact with the boss 50, further rotation acts to push the tooth 70 away from the body part 21 of the adaptor 20, allowing for easy removal of the tooth 70. This may be viewed as movement of the lock 100 between a locked position, in which the lock bears against both first and second bearing surfaces 150, 152; and an unlocked position in which the inside wall 125 bears against the front portion 58 of the boss 50, thus urging the tooth 70 away from the adaptor 20. It will be appreciated that the tooth 70 is urged away in a radial direction from the lock 100, and that its movement is therefore translational.

In this way the lock 100 functions as a release mechanism for the tooth 70, moving between a first position (the locked position) in which the tooth 70 can be coupled to the adaptor 20 and a second position (the unlocked position) in which the tooth 70 is urged away from the adaptor 20.

Figure 25C:
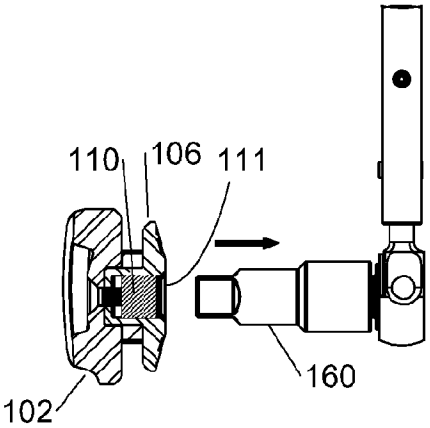
FIGS. 25(*a*) to 25(*c*) are sequential cross sections of the driving tool of FIG. 24 in use.
Figure 24:
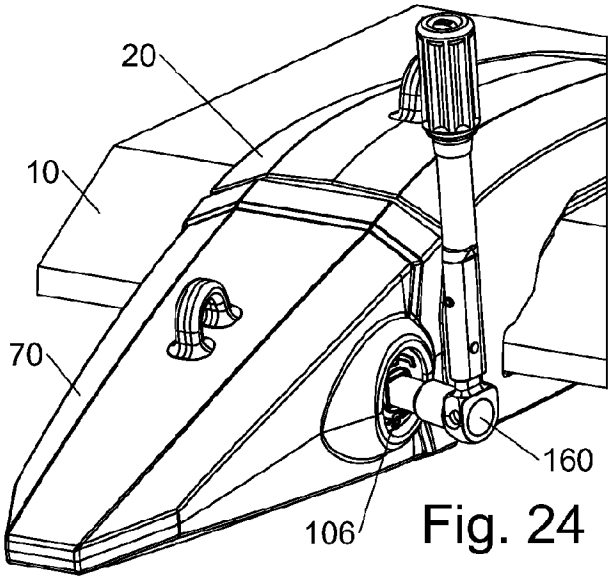
Figure 25B:
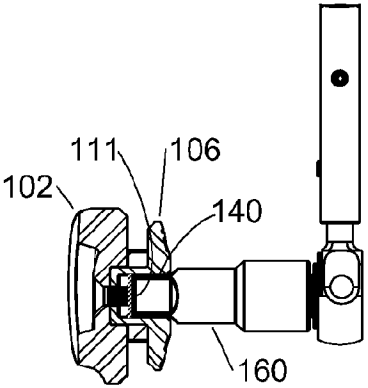
Figure 25A:
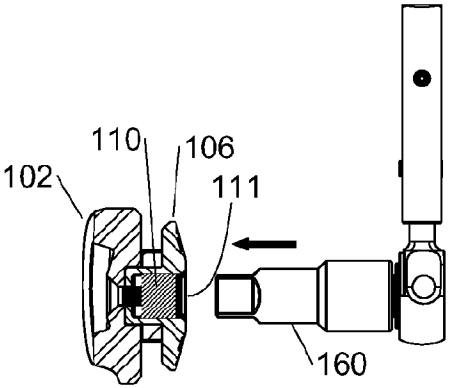
Figure 26:
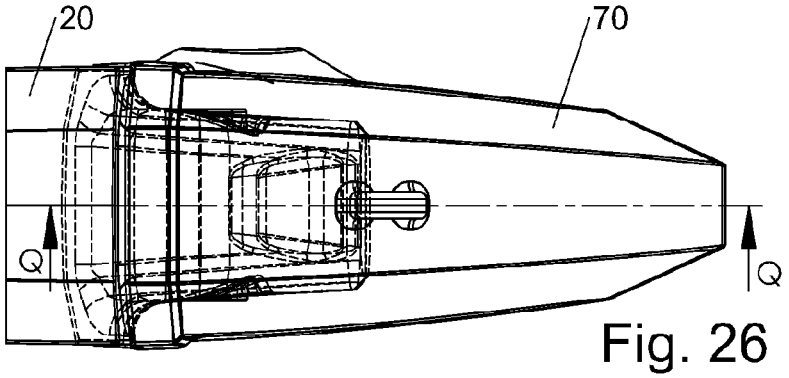
FIG. 26 is a plan view of the adaptor and tooth of FIG. 1.

The lock 100 is maintained in a desired angular position by engagement between the retaining teeth 86 of the toothed ring 84 and the engaging teeth 130 of the engaging ring 104. When rotation of the lock 100 is required, this may be effected using a square-ended driver 160 as shown in FIGS. 24 and 25.

The plug 110 is resilient, with an outer cover 111. Insertion of the square-ended driver 160 into the square-sided recess 140 causes compression of the plug 110, within the square-sided recess 140. When the driver 160 is removed, the plug 110 expands to again fill the recess 140. This sequence can be seen in FIGS. 25(*a*) to 25(*c*).

In addition to the lock 100, coupling of the tooth 70 to the adaptor 20 is assisted by the complementary shape of the adaptor nose 22 and the tooth cavity 72.

The top 28 and bottom 32 of the nose 22 each have a contoured surface, and include a first bearing surface 170 and second bearing surface 172, which are substantially flat, and are separated by concave joining surfaces 174. The first and second bearing surfaces 170, 172 are each narrower than the width of the nose 22, with the first bearing surface 170 being located within an apparent scooped portion 176 of the top 28 and bottom 32 near the front wall 26.

The tooth cavity 72 is largely complementary in shape to the adaptor nose 22, with convex surfaces having curvature slightly less than the concave joining surfaces 174. This ensures small clearances around the curved surfaces, and full contact along the flat bearing surfaces 170, 172.

Figure 27:
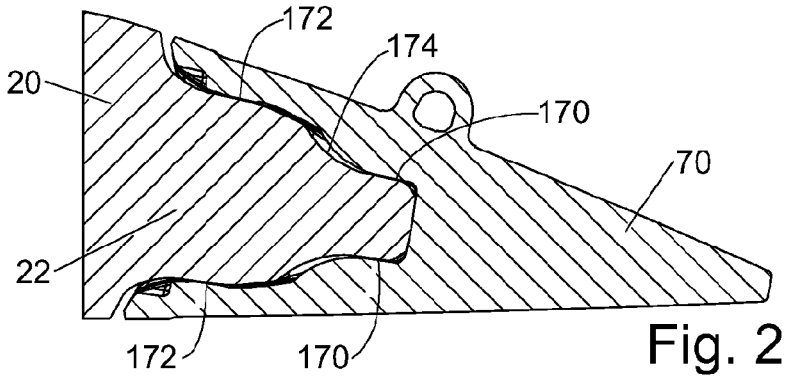
FIG. 27 is a cross section through line Q-Q marked on FIG. 26.
Figure 28:
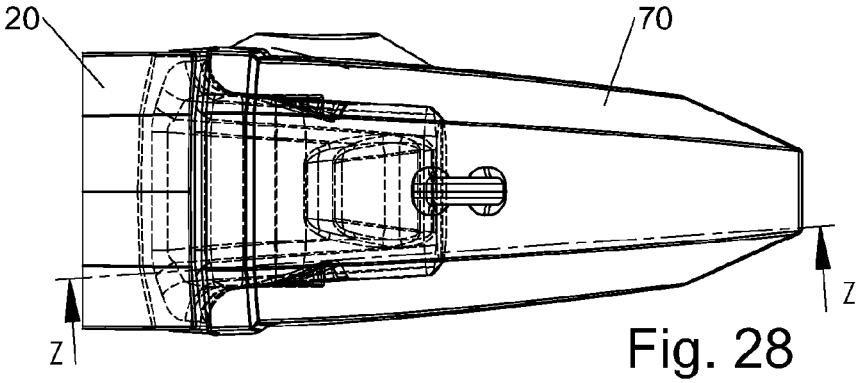
FIG. 28 is a plan view of the adaptor and tooth of FIG. 1.
Figure 29:
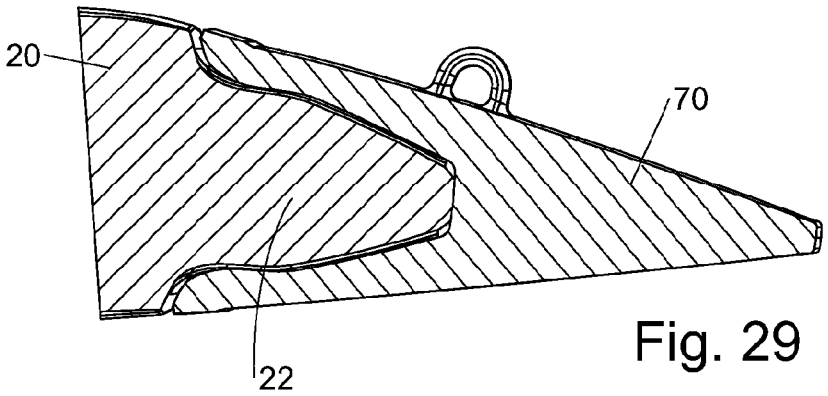
FIG. 29 is a cross section through line Z-Z marked on FIG. 28.
Figure 30:
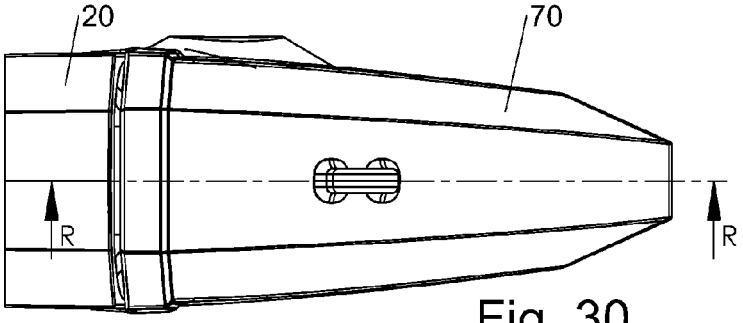
FIG. 30 is a plan view of the adaptor and tooth of FIG. 1.
Figure 31:
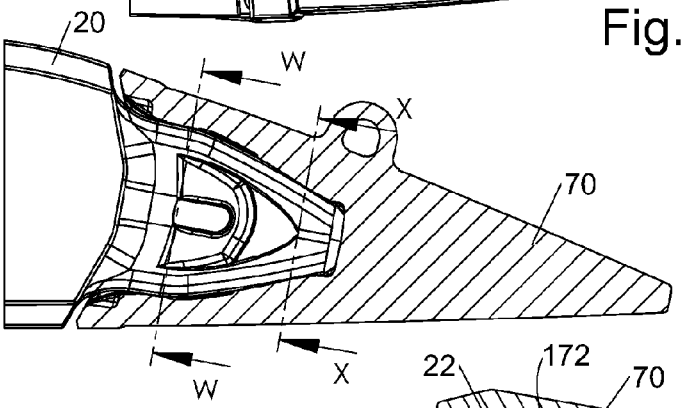
FIG. 31 is a cross section through line R-R marked on FIG. 30.
Figure 32:
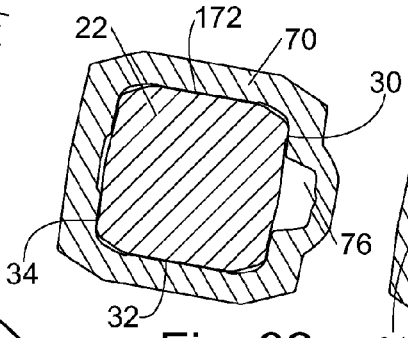
FIG. 32 is a cross section through line W-W marked on FIG. 31.
Figure 33:
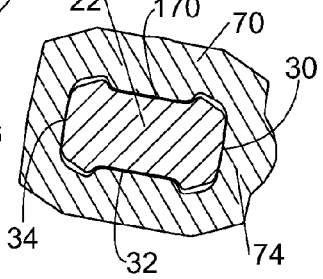
FIG. 33 is a cross section through line X-X marked on FIG. 31.
Figure 34:
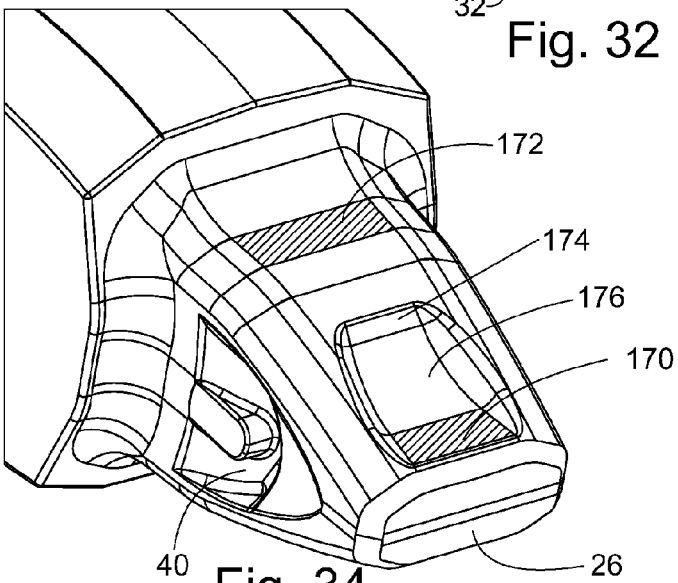
FIG. 34 is a perspective of the nose of the adaptor of FIG. 1, showing some of the bearing areas of the nose.
Figure 37:
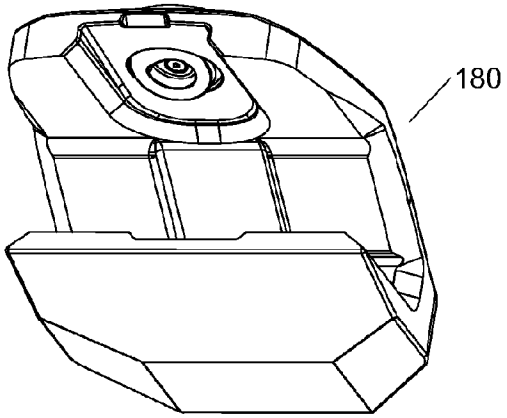
FIG. 37 is a rear perspective of the lip shroud of FIG. 35.
Figure 38:
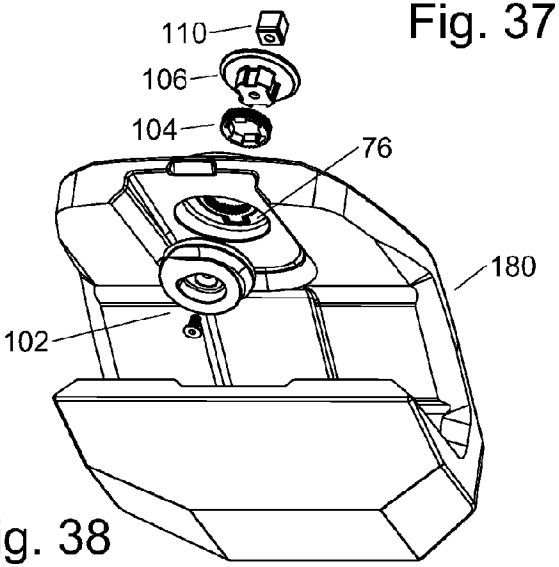
FIG. 38 is a rear perspective of the lip shroud of FIG. 35 shown with an exploded view of a lock from within the coupling of FIG. 35.
Figure 35:
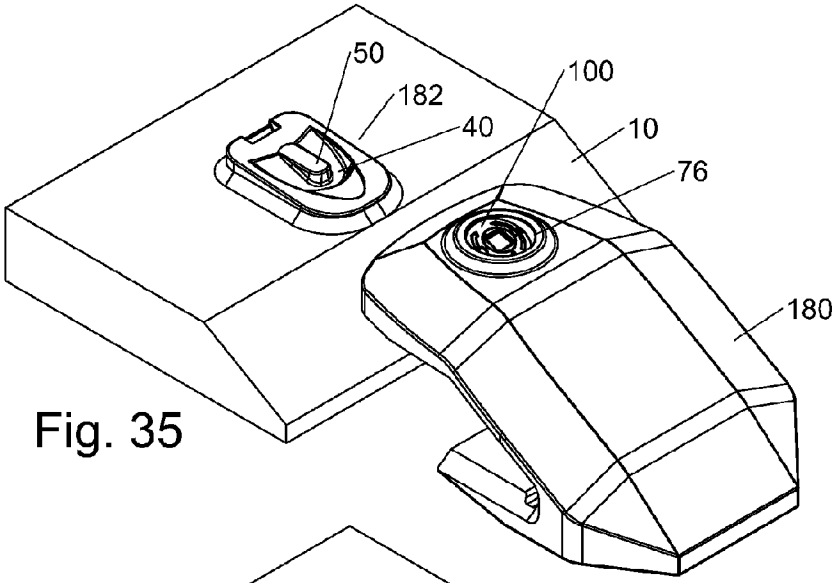
FIG. 35 is a perspective of a bucket lip and lip shroud having a coupling in accordance with the present invention, shown prior to coupling.
Figure 36:
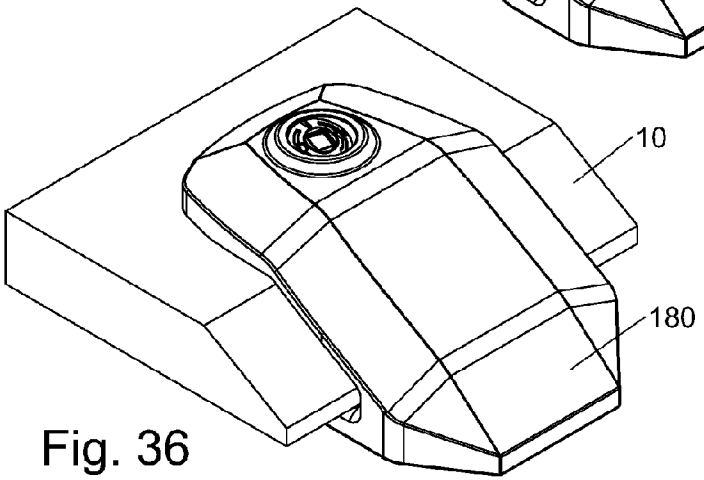
FIG. 36 is a perspective of the bucket lip and lip shroud of FIG. 35 shown coupled.
Figure 39:
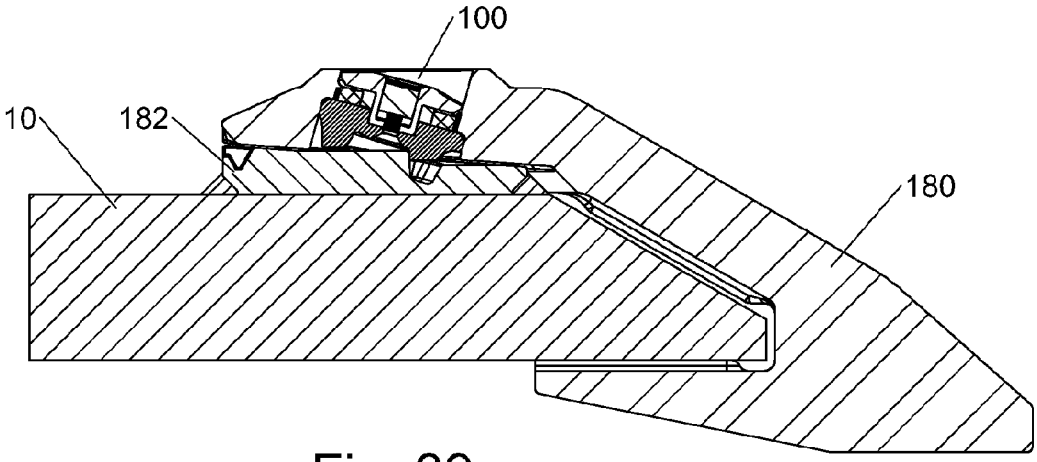
FIG. 39 is a cross section of the bucket lip and shroud of FIG. 35 during coupling.
Figure 40:
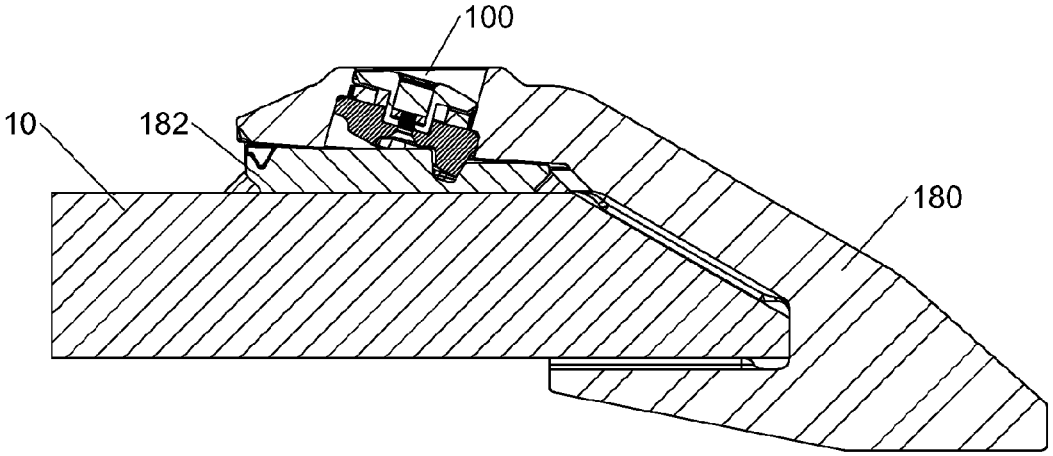
FIG. 40 is a cross section of the bucket lip and shroud of FIG. 35 shown coupled.

The bearing connection between the adaptor 20 and the tooth 70 is in a centre portion of the adaptor nose 22. This can be seen in a comparison between a cross section taken through the centre, as in FIG. 27, and a cross section taken towards the side, as in FIG. 29.

Although the coupling has been described as between a tooth and adaptor, it will be appreciated that other GET couplings can be locked together in a similar fashion. FIGS. 35 to 40 show a lip shroud 180 being connected to a bucket lip 10, onto which has been mounted a lock coupling 182 similar to the first side wall 30 of the adaptor nose 22. A lock 100 identical to that described in relation to the tooth 70 can be used to couple the lip shroud 180 to the lock coupling 182 in an analogous manner.

Modifications and variations as would be apparent to a skilled addressee are deemed to be within the scope of the present invention.

The invention claimed is:

1. A coupling for connecting a wear member to a base, the base including a first bearing surface, the wear member including a second bearing surface; the coupling including a rotatable lock having a bearing member, the bearing member having a first face arranged to bear against the first bearing surface and a second face arranged to bear against the second bearing surface, the first face and the second face facing at least partially radially and the relative positions of the first and second face varying around a central axis of the lock, such that in use rotation of the lock causes rotation of the first face and the second face about the central axis of the lock and alters the distance between the first and second bearing surfaces.

2. A coupling for connecting a wear member to a base as claimed in claim 1, wherein the first face and the second face of the rotatable lock are both arcuate and have respective radii of curvature, with the radius of curvature of at least one of the first or second face varying around the lock central axis.

3. A coupling for connecting a wear member to a base as claimed in claim 2, wherein the second face of the rotatable lock has a constant radius of curvature transverse to the central axis and the first face has a varying radius of curvature transverse to the central axis.

4. A coupling for connecting a wear member to a base as claimed in claim 1, wherein the wear member is arranged to align about the base along a longitudinal axis, and the central axis of the lock is oriented at about 10° to 20° relative to a line perpendicular to the longitudinal axis.

5. A coupling for connecting a wear member to a base as claimed in claim 1, wherein the first face and second face of the rotatable lock are located on a single, one-piece bearing member.

6. A coupling for connecting a wear member to a base as claimed in claim 5, wherein the bearing member includes a body portion, which is cylindrical, and has an outer surface forming the second face of the rotatable lock.

7. A coupling for connecting a wear member to a base as claimed in claim 6, wherein that the bearing member has an engaging portion protruding from one side of the body portion, the engaging portion having an outer surface, at least a part of which forms the first face of the rotatable lock.

8. A coupling for connecting a wear member to a base as claimed in claim 7, wherein the engaging portion is formed from an introductory portion joined to a spiralling portion, the introductory portion having a substantially straight outer edge.

9. A coupling for connecting a wear member to a base as claimed in claim 1, wherein the height of the engaging portion relative to the body portion varies around the engaging portion.

10. A coupling for connecting a wear member to a base as claimed in claim 8, wherein the height of the engaging portion relative to the body portion varies around the engaging portion, the height of the spiralling portion being a minimum at one end of the introductory portion, and at a maximum at a location on the spiralling portion which is located on a line which is perpendicular to the introductory portion and which passes through the central axis of the lock.

11. A coupling for connecting a wear member to a base as claimed in claim 5, wherein the bearing member is coupled to an operable member.

12. A coupling for connecting a wear member to a base as claimed in claim 11, wherein the operable member includes a keyed projection which engages with a keyed recess in the bearing member.

13. A coupling for connecting a wear member to a base as claimed in claim 11, wherein the wear member has an internal cavity, with an aperture passing through a side wall of the wear member into the cavity, the aperture including an inner region in which the bearing member can be received, the inner region including the second bearing face, and an outer region in which the operable member can be received.

14. A coupling for connecting a wear member to a base as claimed in claim 13, wherein the inner and outer regions are separated by a toothed ring, arranged to engage with a toothed ring located about the rotatable lock.

15. A coupling for connecting a wear member to a base as claimed in claim 14, wherein at least one of the toothed rings is resilient, such that engagement of the respective teeth maintains the lock in a desired angular position, but whereby the application of an angular force to the operable member causes deformation of the resilient toothed ring to allow rotation of the lock.

16. A coupling for connecting a wear member to a base as claimed in claim 11, wherein the operable member includes a tool-receiving recess in which is located a plug formed at least partially of resilient material.

17. A coupling for connecting a wear member to a base as claimed in claim 1, wherein the base includes a side wall having a recess, the recess having an arcuate wall which forms the first bearing surface.

18. A coupling for connecting a wear member to a base as claimed in claim 17, wherein the recess is generally tapered towards the arcuate wall.

19. A coupling for connecting a wear member to a base as claimed in claim 7, wherein the base includes a side wall having a recess, the recess having an arcuate wall which forms the first bearing surface, the recess includes a boss spaced from the arcuate wall, and the engaging portion being generally annular, with an outside wall and an inside wall; the boss being arranged to engage with the inside wall of the engaging portion of the bearing member in some angular positions, to promote disengagement of the wear member from the base during removal.

20. A coupling for connecting a wear member to a base as claimed in claim 1, the lock having at least two positions: a locked position whereby the wear member is restrained from moving relative to the base and an unlocked position in which the wear member is able to move relative to the base in an unrestrained manner, and wherein moving the lock from the locked position to the unlocked position urges the wear member away from the base.

21. A coupling for connecting a wear member to a base as claimed in claim 20, wherein the lock is rotatable, with the two positions corresponding to two angularly spaced positions of the lock, and with rotation of the lock from the locked position to the unlocked position causing movement of the wear member relative to the base.

22. A coupling as claimed in claim 21, wherein the movement of the wear member is substantially translational.

23. A coupling as claimed in claim 22, wherein the movement of the wear member is substantially radial relative to the lock rotation.

24. A coupling for connecting a wear member to a base as claimed in claim 1, wherein the relative positions are radial positions relative to the central axis.

25. A coupling for connecting a wear member to a base member as claimed in claim 1, wherein the rotation of the lock alters the distance between the first and second bearing surfaces transverse to the central axis.

26. A coupling for connecting a wear member to a base as claimed in claim 2, wherein the relative positions are radial positions relative to the central axis.

27. A coupling for connecting a wear member to a base member as claimed in claim 2, wherein the rotation of the lock alters the distance between the first and second bearing surfaces transverse to the central axis.

28. A coupling for connecting a wear member to a base, the base including a first bearing surface, the wear member including a second bearing surface; the coupling including a rotatable lock having a first face arranged to bear against the first bearing surface and a second face arranged to bear against the second bearing surface, the lock having a central axis about which it can be rotated, the first and second face being both axially and circumferentially spaced relative to the central axis of the lock, such that in use the lock can be rotated between a position in which the first and second face bear against the first bearing surface and second bearing surface respectively, and a position in which the first face does not bear against the first bearing surface and/or the second face does not bear against the second bearing surface.

29. A coupling for connecting a wear member to a base, the base including a first bearing surface, the wear member including a second bearing surface; the coupling including a rotatable lock having a circumferential first face arranged to bear against the first bearing surface and a circumferential second face arranged to bear against the second bearing surface, the relative positions of the first and second face being axially spaced relative to a central axis of the lock, a radial distance between the first and second faces varying around the central axis, such that in use rotation of the lock alters the distance between the first and second bearing surfaces.

30. A coupling for connecting a wear member to a base as claimed in claim 29, wherein the relative positions are radial positions relative to the central axis.

31. A coupling for connecting a wear member to a base member as claimed in claim 29, wherein the rotation of the lock alters the distance between the first and second bearing surfaces transverse to the central axis.

* * * * *